US005933077A

United States Patent [19]

Vogt et al.

[11] Patent Number: 5,933,077

[45] Date of Patent: Aug. 3, 1999

[54] APPARATUS AND METHOD FOR DETECTING UNDESIRABLE CONNECTIONS IN A SYSTEM

[75] Inventors: William R. Vogt, County of Morris; Leonard Noonan, County of Sussex, both of N.J.

[73] Assignee: Wells Fargo Alarm Services, Inc., King of Prussia, Pa.

[21] Appl. No.: 08/879,915

[22] Filed: Jun. 20, 1997

[51] Int. Cl.[6] ..... G08B 29/00

[52] U.S. Cl. ..... 340/506; 340/505; 340/508; 340/825.16

[58] Field of Search ..... 340/506, 511, 340/505, 825.06, 508, 825.16

[56] References Cited

U.S. PATENT DOCUMENTS

| | | | |
|---|---|---|---|
| 4,249,166 | 2/1981 | Schultz | 340/505 |
| 4,470,047 | 9/1984 | Vogt et al. | 340/511 |
| 4,850,018 | 7/1989 | Vogt | 340/505 |
| 4,916,432 | 4/1990 | Tice et al. | 340/506 |
| 4,951,029 | 8/1990 | Severson | 340/506 |

*Primary Examiner*—Donnie L. Crosland

*Attorney, Agent, or Firm*—Polster, Lieder, Woodruff & Lucchesi, L.C.

[57] ABSTRACT

An alarm system includes a controller (20), a plurality of transponders (23–26), and a transducer (50) connected to one of the transponders (23). A voltage reference which is preferably earth ground is established for the entire alarm system. A local loop comprises a pair of electrical conductors (72, 73) connecting the transducer and transponder. The transponder includes a comparator (70, 80, 80–82) having a fixed reference input and a second input which is the voltage level on the local loop. If a ground fault or other abnormal condition occurs, this is sensed by the comparator and an indication provided a loop status portion (60*a*) of the transducer. The controller includes a communications module (27) by which each transponder is addressed, and the transponder includes an output response portion (60*b*) by which the transponder identifies itself to the controller as the transponder at which the ground fault or other abnormal condition has occurred.

9 Claims, 4 Drawing Sheets

APPARATUS AND METHOD FOR DETECTING UNDESIRABLE CONNECTIONS IN A SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention is directed to apparatus and a method for detecting an unexpected connection in an alarm system such as an alarm communications system having a controller communicating with a plurality of transponders. More particularly, the invention enables the detection and reporting not only of an abnormality which occurs between a specific transponder and a transducer it is monitoring, but also at which transponder the malfunction or abnormality has occurred.

Alarm systems which provide two-way communications between a controller and a plurality of transponders, or modules, are now well-known and widely used for providing life, safety and security protection. Typically, the transponders have one or more transducers connected or coupled to them. For operating such systems, regulatory agencies require that the system have a high level of reliability in detecting and reporting alarm conditions. This is true even if, for example, there is an unexpected connection to earth ground between a transponder and a connected transducer. The transducer can be a temperature sensor, door position sensor, motion detector, or other sensor. It is desirable that the transponder accurately detect and report back necessary system data, even in the event of an unexpected connection to earth ground on a local loop between the transducer and transponder. It is further desirable that the system also report the fact of an occurrence and the location of the ground fault or other anomaly. While most systems can tolerate one ground fault for a limited time, location and repair of the fault is highly desirable before a second fault occurs which may cause the entire system to malfunction.

In order to tolerate this undesirable connection, system designers often decrease the impedances of a transducer's sensing circuits. This normally enhances the stability of the sensing circuit. However, to allow the sensing circuit to identify an undesirable connection, one would want to design the circuit with higher impedances, thereby allowing the sensing circuit to be responsive to outside influences. These two requirements are conflicting. If the circuit is able to "ignore" the fault for reliable alarm reporting, then it is consequently difficult to recognize the presence of the fault, much less determine and report its location.

BRIEF SUMMARY OF THE INVENTION

Among the several objects of the present invention may be noted the provision of an alarm system and method of system operation which not only reliably monitors a transducer, but also detects and reports the presence of certain faults, such as ground faults which occur between the transducer and its associated transponder;

the provision of such a system and method of operation to detect a fault when it occurs, but to report the occurrence either real time or store the location information for subsequent transfer to a controller for the system;

the provision of such a system and method of operation in which a reference is established for the system and the occurrence of a fault is sensed by determining the relationship between any point in the system and the reference;

the provision of such a system and method of operation in which, under certain prescribed conditions, the status of a transducer can also be sensed and the reported to the controller in real time or stored for transmission to the controller on a delayed basis; and, the provision of such a system and method of operation which is particularly useful in an addressable multiplexed system.

In accordance with the invention, generally stated, an alarm system, for example, an addressable multiplex system, has a controller which communicates with a plurality of transponders over electrical conductors or coaxial cable. At least one of the transponders is coupled over a local loop, including a pair of wires, to a transducer. At one point in the system, a reference voltage level is established, for example by placing earth ground at a known voltage level relative to voltage levels used in the system. The transponder to which the transducer is coupled has a detection capability by which, when the voltage level on the local loop is not at its expected level, due to a ground fault connection or other undesirable connection on the local loop, this condition is readily sensed. The transponder can effectively isolate the local loop from electrical conductors connected to the controller and the transponders. This isolation eliminates the effect of any low impedances on the local loop, and allows detection of a ground fault or other undesirable connection. This same transponder also has a transmission capability which is operable by the controller so the transponder can report back to the controller data regarding a ground fault occurrence at that transponder location.

As a method, the invention includes the establishment of a voltage difference between a system reference voltage and earth ground. A selected portion of the system, which may be the conductive line between the transponder and the transducer, is sensed for response to an impedance between the selected portion of the system and earth ground. This sensing is accomplished by effectively isolating the conductive line by temporarily disconnecting the low impedances normally used to monitor the transducer, and allowing the conductive line to be influenced by external impedances and voltages, such as connections to ground and other undesirable connections. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DESCRIPTION OF PREFERRED EMBODIMENTS

By way of a background, earlier alarm systems which have proved efficacious in detecting and reporting alarms are found in three issued United States patents, all identified as "Bi-directional, Interactive Fire Detection System", and issued in the names of William R. Vogt and John M. Wynne. These are U.S. Pat. Nos. 4,394,655 issued Jul. 19, 1983, 4,470,047 issued Sep. 4, 1984, and 4,507,652 issued Mar. 26, 1985. These patents describe the systems in which a transducer (or contact) is associated with a transponder, and provides information to the transponder (such as temperature rise, door open, movement of a person, and so forth). In turn the transponder (or system "point") relays the information regarding its associated transducer back to a system controller when it is appropriate for that transponder to communicate in the normal operation of the system. Information regarding troubles in the operation of a transponder have been effectively diagnosed and the difficulty reported back to the controller in these earlier systems. However, if there is a problem, such as an unauthorized connection on the line between a specific transponder and its associated transducer, the identification of the specific transponder where this has occurred has not been detectable in those systems where the controller is connected over electrical conductors to the transponders, unless there was electrical isolation between the transponders and the controller.

Figure 1:
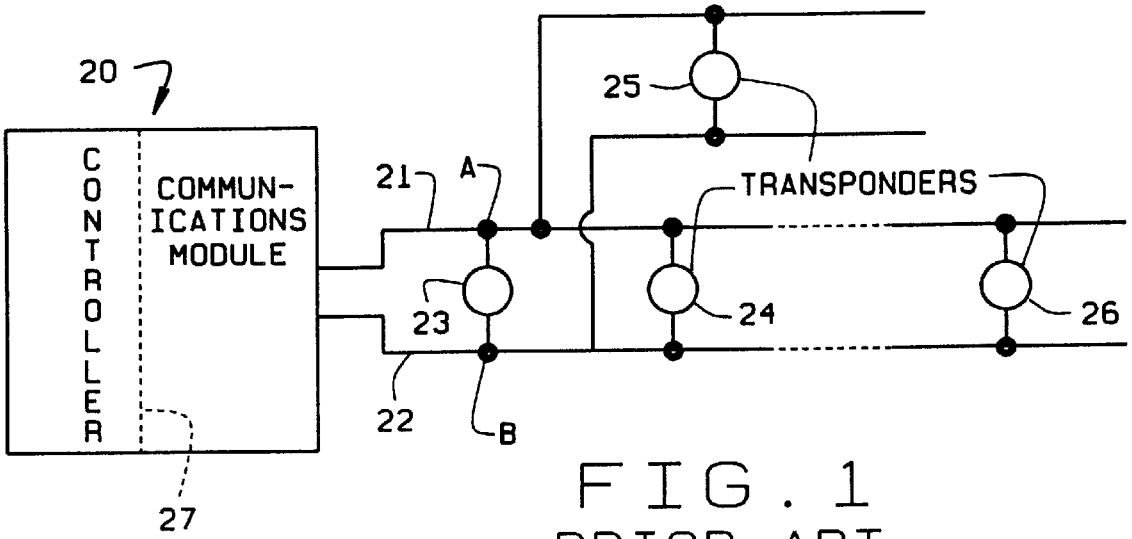
FIG. 1 PRIOR ART
FIG. 1 is a block diagram depicting an alarm system with a controller and associated transponders.

Referring to FIG. 1, a system arrangement as described in the aforementioned prior art patents is shown. Here, a system controller 20 communicates over conductors 21, 22 with a plurality of transponders 23–26. There is a solid electrical connection between the controller and each of the transponders, each of the transponders being connected in parallel across conductors 21, 22. Preferably, the transponders 23–26 are separately addressable transponders which can be individually polled by controller 20. For this purpose, controller 20 includes a communications module 27 by which the transponders can be polled. When addressed by the controller during a polling sequence, each transponder will provide status information to the controller as described hereinafter.

Figure 2:
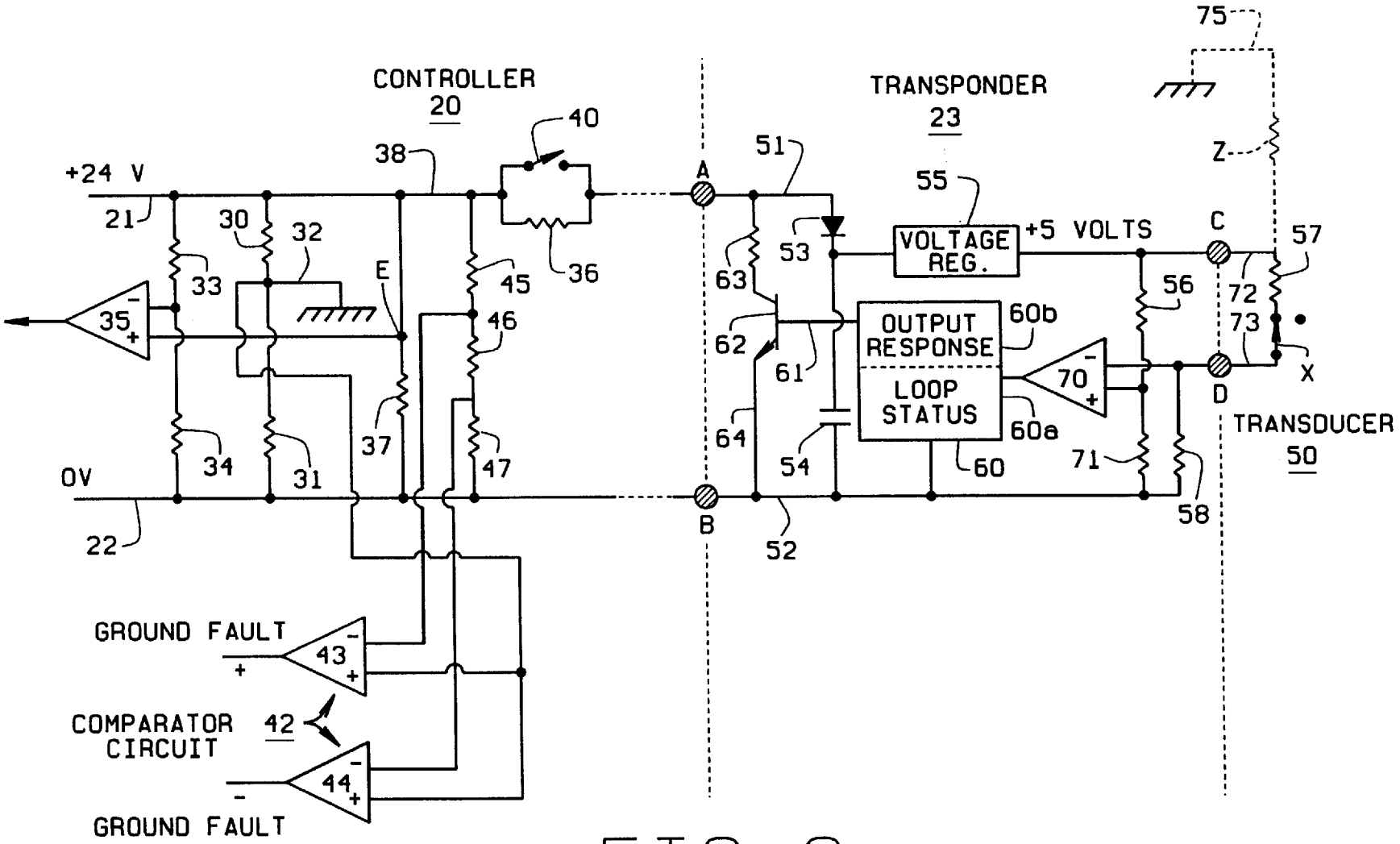
FIG. 2 is a partial schematic diagram of an alarm system useful in understanding the present invention.

In FIG. 2, a supply of 24 volts is applied between conductor 21 and system ground (or reference) conductor 22. A first pair of resistors 30, 31 is series connected between the conductors, and an earth ground reference conductor 32 is connected at the common connection between the resistors as well as to earth ground. This latter connection can be made at any suitable point. Resistors 30, 31 are preferably of equal resistance. It will be understood that the earth ground need not be positive relative to the voltage on conductor 22, but only that a reference voltage level be established other than the level on reference conductor 22. In the preferred embodiment of the invention, earth ground is positive relative to the voltage level on conductor 22.

Next, a second pair of resistors 33, 34, both of which are of similar value but with resistor 33 having a slightly greater resistance than resistor 34, are connected in series between conductors 21, 22. A comparator 35 has a reference input connection, which is established at slightly lower than 12 volts, connected to the common connection between resistors 33, 34. The sensing (+) input of comparator 35 is connected at a common connection E between resistors 36 37, and a conductor 38. Resistors 36, 37 are of equal value, and a switch 40 is connected in parallel with resistor 36. When switch 40 is open, 24 volts is developed across resistors 36, 37, and a positive 12 volts appears at point E. When a transistor 62 closes, the voltage at point E falls significantly below 12 volts, and comparator 35 recognizes this as a switch closure. The signaling operation associated with this sensing process is discussed in the above referenced patents.

A known method of searching for a ground fault indication includes a comparator circuit 42 which includes comparators 43, 44. A voltage divider array comprising resistors 45–47, is series connected between conductors 38, 22. These resistors may have the same value; however, reducing the value of resistor 46 with respect to resistors 45 and 47 will make the circuit less tolerant to a ground fault impedance. Comparator 43 has its reference input connected between resistors 45, 46, and comparator 44 has its reference input connected between resistors 46, 47. A sensing connection to both comparators is connected to the common connection between resistors 30, 31 (the earth ground connection) and represents a positive 12 volts in the illustrated system. If a ground fault now occurs with respect to conductor 38, an impedance will effectively be placed in parallel with resistor 30 causing the voltage at reference point 32 to rise. The output of comparator 43 will reflect this occurrence. If a ground fault occurs with respect to any of the conductors 22, 52, 72, or 73, an impedance will effectively be placed in parallel with resistor 31, causing the voltage at reference point 32 to fall. The output of comparator 44 will reflect this occurrence. It is a drawback of this fault sensing technique that if there are multiple transponders 23, connected in parallel across A and B; that, even though comparator circuit 42 can indicate that a ground fault is present, it cannot identify which transponder has the fault connected to it.

In transponder 23, the 24 volt potential is applied over terminals A and B to input conductors 51, 52. A diode 53 and capacitor 54 are series connected between these conductors and provide a voltage input to a voltage regulator 55. A +5 volt output of the regulator is applied to a terminal C via resistor 56. The transponder further includes an integrated circuit (IC) chip 60 which includes various circuitry including a loop status circuit 60*a* and an output or status response circuit 60*b*. Circuit 60*a* receives data or information about the transducers 50 associated with the transponder, and response circuit 60*b* provides data or status information back to the controller 20 when communication module 27 in the controller communicates with the transponders and accesses transponder 23 at its particular address within the system.

Timed to occur while switch 40 is open, the response to the controller from chip 60 is via line 61 to transistor 62, an npn-type transistor, whose collector is connected to conductor 51 through a resistor 63. The emitter of the transistor connects over line 64 to conductor 52. When transistor 62 is "on", the voltage between lines 51, 52 (and accordingly lines 38, 22) is sharply reduced. This change is sensed by comparator 35 of controller 20. In accordance with the invention, a detector indicated generally 70 has its output connected to an input of chip 60; i.e., to the loop status portion 60*a* of the chip. Detector 70 comprises a comparator whose operation is well-known in the art and is not described. The reference input to the comparator is from the junction of resistors 56 and 71. These resistors are of equal value, resulting in a reference voltage of 2.5 volts for the comparator.

Transducer 50 includes local loop conductors 72, 73 which respectively connect to transponder terminals C and D. The transducer further includes a resistance 57 and switch or sensing element X.

In the alarm system of FIG. 2, when there is no ground fault or other unauthorized connection to the local wire loop conductors 72, 73, the output of comparator circuit 42 is stable. Resistors 57 and 58 are of a ratio of 2:3, where resistor 57 is 2x and resistor 58 is 3x, and the voltage level at terminal D is 3 volts with switch X closed. However, if there should be a ground fault occurrence (as represented by the dashed line 75 in FIGS. 2 and 3A) on conductor 72, then with switch X closed, the signal input voltage to comparator 70 goes more positive since earth ground appears to be +12 volts relative to the system ground. The changed output from comparator 70 is provided to the loop status memory as an indication that an abnormal condition (ground fault or other unexpected condition) exists on the wire loop connected to terminals C and D of transponder 23. The loop status circuit retains this information and provides a corresponding status input to controller 20 when transponder 23 next recognizes its address during a poll. This enables the system to identify the location of the ground fault or other malfunction as adjacent transponder 23. It is important that an indication from comparator 70 be stored in the loop status portion of chip 60 so that controller 20 can be informed of the condition, even though the condition may go away before communication occurs between the transponder and the controller. Those skilled in the art will appreciate that there are polled and non-polled multiplex systems, and that data regarding the local loop status may, or may not, be in the next communication to the controller. Such data may be sent immediately, or in response to a request from the controller, or may be held for some extended period of time in the transponder before being sent to the controller. This allows the occurrence of an abnormal condition to always be sent to the system operator so its cause can be investigated and any problem corrected as soon as practicable. Most alarm systems can tolerate a single fault, because the lines will drift only slightly in the direction (that is, toward the voltage level) of the fault, but useful information can still be transmitted and received under this condition. However, if a second fault or ground occurs before the first one is cleared, then the system is disrupted and it may no longer send and receive desired information.

In the embodiment of FIG. 2, a comparator 70 is shown. As is described hereinafter with respect to FIG. 3B, two or more comparators may be used to better define the information regarding a fault or abnormal condition. Use of additional comparators helps provide an indication as to whether the fault is driving the local wire loop of conductors 72, 73 in a positive or negative direction.

Figure 3A:
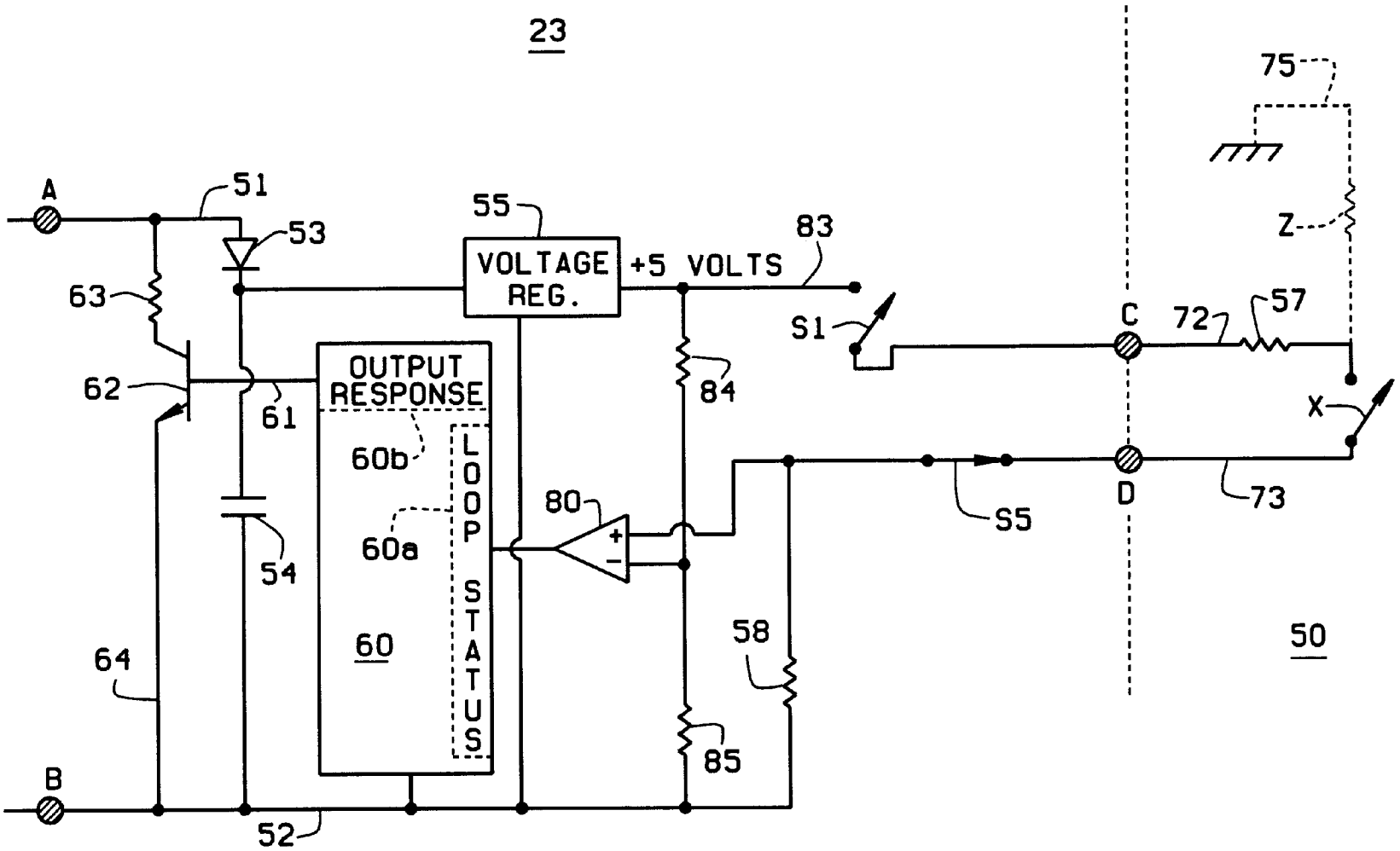
FIG. 3A is a partial schematic diagram of a first embodiment of the invention.

Referring now to FIG. 3A, the present invention includes circuitry for isolating the transponder when fault detection is in progress. First, though, it will be understood that in the system as presented, earth ground is 12 volts positive with respect to the system ground potential on line 52. However, it is also important to understand that earth ground need not be positive relative to the voltage on reference conductor 52, but only be established at a voltage level other than that to which it is being compared. Further, for purposes of detecting a ground fault or other abnormal condition, it is also important to understand that it is not the magnitude of the difference between the reference and sensed fault condition that is significant; but rather, that the occurrence of a ground fault always results in the resulting sensed value be positive (or negative if so established) with respect to the system reference.

Figure 4:
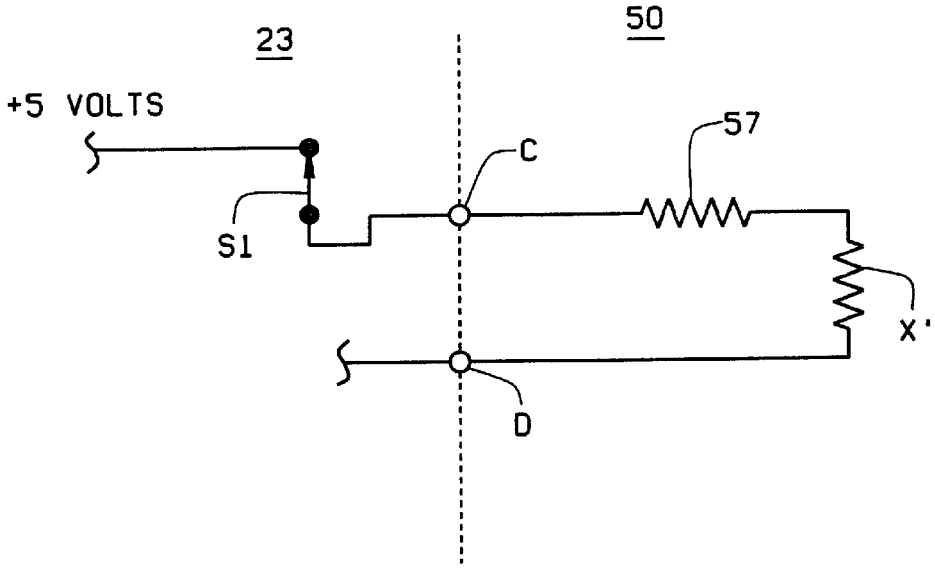

In FIG. 3A, a comparator 80 has a reference input which is provided by the output of a voltage divider network comprising resistors 84, 85. The voltage divider is connected between conductors 83, 52. The sensing input to the comparator is provided through terminal D of transponder 23 from transducer 50. Now, a switch S1 is interposed in conductor 83 between voltage regulator 55 and transponder terminal C. When switch S1 is open as shown in FIG. 3A, the local loop is disconnected from the low impedance supply used during normal monitoring of the local loop. This allows the detector portion of the transponder to be responsive to a fault such as the ground fault 75 which has an associated impedance Z. Operation of the detector is as described with respect to comparator 70 of FIG. 2, as are the functions of the loop status portion 60*a* and output response portion 60*b* of chip 60. Further, it will be understood that when switch S1 is closed, the detector can additionally check the status of the transducer. This configuration is as shown in FIG. 4 where the transducer element is represented as an impedance X' rather than as a switch. This is because, in actuality, the transducer element can either be physically connected to, or coupled with, the alarm system.

In accordance with another aspect of the invention, a switch S5 is connected between terminal D and the common connection between resistor 58 and the sensing input connection of comparator 80. With this arrangement, both switches S1 and S5 can be opened to effectively isolate the transducer. If an abnormal condition is present at the transducer, then the controller can recognize the return to normal of comparator circuit 42 while the transponder has the transducer isolated. Therefore, comparator circuit 42 functions as a recognition means so that the controller can recognize that the abnormality was associated with the specific transponder that isolated its transducer. When a system contains multiple transponders and multiple transducers respectively connected to those transponders, then systematically isolating the transducers, while monitoring comparator circuit 42 will allow the controller to recognize the specific transponder associated with the change of state of comparator circuit 42.

Figure 3B:
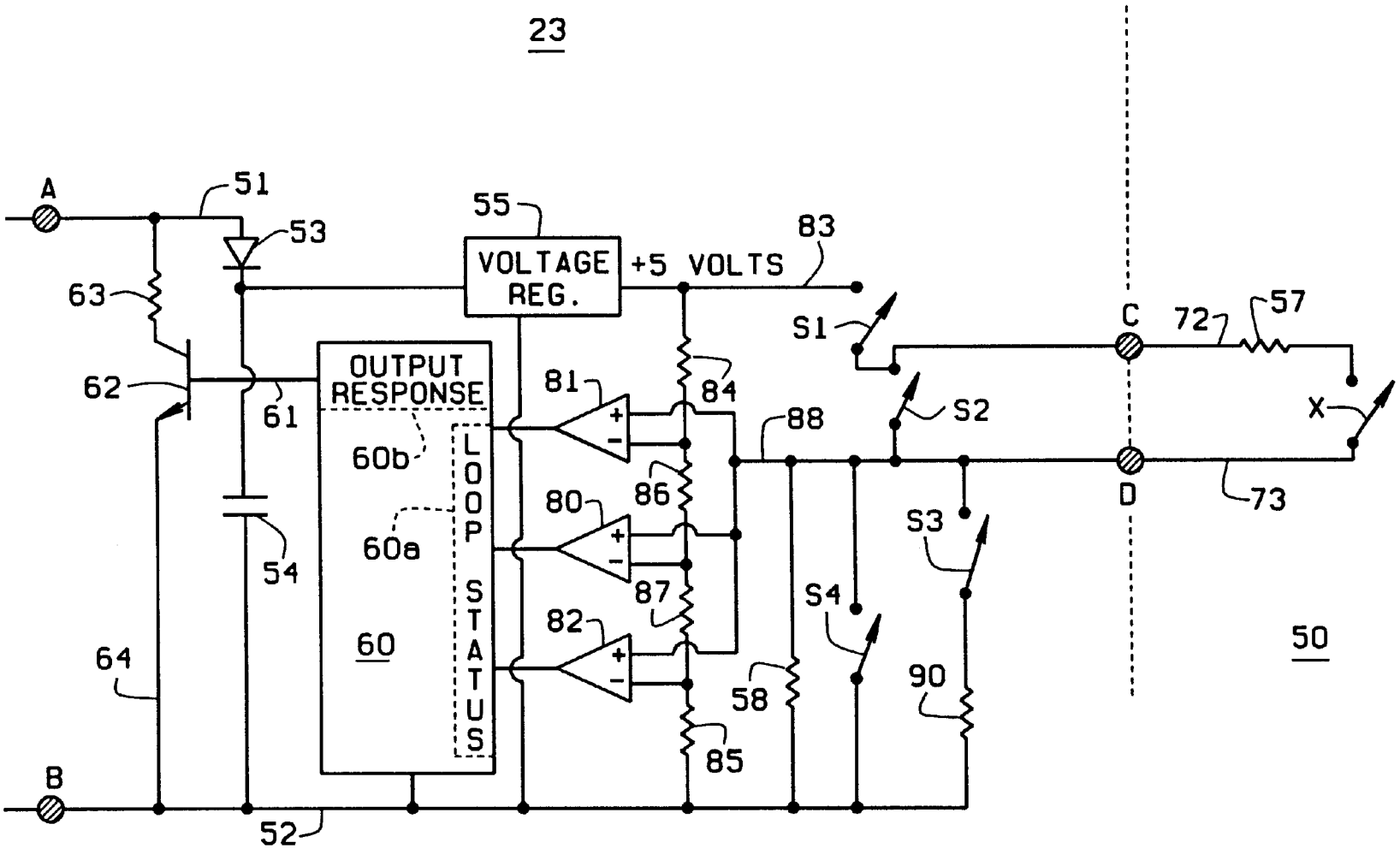
FIG. 3B is a partial schematic diagram of a second embodiment of the invention; and, FIG. 4 is a partial schematic diagram illustrating the capability of the system further to sense the status of a transducer connected to a transponder.

In FIG. 3B, an array including comparators 80, 81 and 82 is now used to provide transducer status information to loop status portion 60*a* of chip 60. The +5 volts output from regulator 55 is applied over conductor 83 to one end of a voltage divider including series-connected resistors 84, 85, 86 and 87. The other side of resistor 85 is connected to conductor 52, the system reference or ground conductor. The reference inputs of comparators 80, 81 and 82 are respectively connected to the different points in the voltage divider circuit as shown. The sensing inputs of comparators 80, 81 and 82 are commonly connected, and are connected to terminal D of the transponder via conductor 88. In accordance with the present invention, switches S1, S2, S3 and S4, and a resistor 90, are connected in the circuit of transponder 23 to make possible the testing for, and identification of, ground faults and other unexpected connections on the system. The series combination of switch S3 and a resistor 90 is connected between reference conductor 52 and conductor 88. Although not shown for the sake of drawing clarity, it will be understood that the operation of the switches is controlled by other circuitry incorporated in chip 60.

The system of the invention is particularly useful in an addressable system, where the controller only receives information from one transponder at a given time (or on a given frequency, or whatever other arrangement is used to separate and identify the returned information). In the embodiment of FIG. 3B, comparator circuit 80–82 functions as a recognition means to recognize an abnormality associated with its transponder when the isolation of the transducer from that transponder occurs. Considering switches S1–S4 as shown in FIG. 3B, in normal operation in which the status of transducer switch X is monitored, switches S2 and S4 are in their open position and switches S1 and S3 are in their closed position. To detect an unexpected ground, undesirable connection, or other abnormal condition on the monitoring system, switches S1 and S3 are opened, thus disconnecting the low impedance circuits. Sensing of the loop can now be performed by comparators 80, 81 and 82. Comparator 81 will only output when a ground fault of a relatively low impedance is present. Comparator 80 will output when ground faults of relatively low impedance or medium impedance are present. Comparator 82 will output when ground faults of low, medium and high impedances are present. The impedance levels that can be sensed are primarily controlled by resistor 58. When resistor 58 is small in value, the impedance to the fault must be very low in order to bring the voltage sensed over wire 88 to a value high enough to cause one or more of the comparators to output.

Further control of switches S2 and S4, though not necessary, provide additional features. Closing switch S2 shorts both sides of the local loop together, making unexpected connections on either side of the loop react the same, even if the sensed transducer X is in an open state during the sensing operation. Switch S4 can be momentarily closed to discharge any stray capacitance which may be on the wire loop, effectively giving the local loop a known starting point. The inclusion of these last two control switches S2 and S4 is optional, as the detection of the undesired connection can still be effected without discharging any stray capacitance, and testing only one side of the local loop should transducer X be open.

All switches, S1, S2, S3, and S4 are included in the preferred embodiment. The sequence of operation of these switches: starting with normal monitoring operation with switches S1 and S3 closed, and switches S2 and S4 open; first, open is: switches S1 and S3 to remove low impedance circuits; second, close switches S2 and S4 to discharge any capacitance connected to either side of the local loop; third open switch S4 to allow sensing to occur while leaving switch S2 closed to insure that faults on either side of the loop are detected equally. Finally, with the switches in their above described positions, the outputs of the respective comparators 80–82 are read to determine if there is an undesired voltage connected, as well as the level of such undesired voltage. This provision and operation of the switches S1–S4 makes it possible to determine precisely at which location the ground fault or other anomaly has occurred, this being accomplished by appropriately opening and closing the respective switches and monitoring the outputs of the respective comparators.

What has been described is an alarm system and method of system operation for monitoring a transducer, and detecting and reporting the presence of ground faults and other abnormal conditions. Importantly, the report of an occurrence is either real time or the location information is stored for later transfer to a system controller when it polls the transponders. The method of the invention requires establishment of a system with the occurrence of a fault being sensed by determining the relationship between any point in the system and the reference which is preferably earth ground. Under other operating conditions, the status of a transducer can also be sensed and reported to the controller in real time or on a delayed basis.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A method of detecting the occurrence of a ground fault or other abnormal condition other than an alarm condition in an alarm system having a controller, a plurality of transponders connected to the controller for communications between the controller and the transponders, and at least one transducer connected to one of the transponders, the method comprising:

establishing a local loop between said transducer and said one transponder, said ground fault or other abnormal condition other than an alarm condition occurring in said local loop;

establishing a voltage reference for the system;

sensing any difference between said reference and a voltage present on the local loop;

detecting when the difference between said reference and the voltage present on the local loop represents a ground fault occurrence or other abnormality other than an alarm condition;

disconnecting said transducer from said transponder to isolate said transducer when a ground fault or abnormal condition other than an alarm condition occurs to ascertain where in said local loop the ground fault or abnormal condition is located; and, providing an indication of the occurrence from said one transponder to said controller when said transponder is polled by said controller whereby the location within the alarm system where a ground fault or other abnormal condition has occurred is timely provided to an operator of the system.

2. The method of claim 1 wherein said indication is provided to said controller as soon as said ground fault or abnormal condition occurs.

3. The method of claim 1 wherein said indication is stored at said transponder and provided to said controller when said transponder is subsequently polled by said controller for said indication to be provided even if said ground fault or other abnormal condition is no longer present.

4. The method of claim 1 wherein said voltage reference for said system is established at earth ground.

5. The method of claim 1 further including providing an indication of the occurrence on a delayed time basis, delayed time reporting allowing the occurrence to be reported even if said transponder is not being polled at the time of the occurrence, and if the abnormal condition no longer exists when said transponder is next polled.

6. In an alarm system comprising a controller and a pair of electrical conductors, a plurality of transponders connected to the controller by the conductors for communication between the controller and the transponders, each transponder having at least one transducer connected thereto, apparatus detecting the occurrence a ground fault or other abnormal condition other than an alarm condition comprising:

a second pair of electrical conductors connecting each transducer to its associated transponder with said second pair of electrical conductors establishing a local loop;

means establishing a voltage reference for said alarm system;

a detector associated with each transducer for detecting a voltage present on the local loop and providing an indication when a difference between said voltage reference and the detected voltage is indicative of a ground fault or abnormal condition other than an alarm condition having occurred;

means disconnecting said transducer from its associated transponder to isolate said transducer to ascertain where in said local loop the ground fault or abnormal condition is located; and, means providing an indication of the occurrence from said transponder to said controller when said transponder is polled by said controller whereby the location within the alarm system where a ground fault or other abnormal condition has occurred is timely provided to an operator of the system.

7. The apparatus of claim 6 wherein said means establishing said voltage reference establishes said reference at earth ground.

8. The apparatus of claim 6 wherein said means providing an indication of the occurrence provides said indication on a delayed time basis, delayed time reporting allowing the occurrence to be reported even if said transponder is not being polled at the time of the occurrence, and if the abnormal condition no longer exists when said transponder is next polled.

9. The apparatus of claim 8 wherein said indication is stored at said transponder by said means providing said indication, said means providing said indication to said controller when said transponder is subsequently polled by said controller for said indication to be provided even if said ground fault or other abnormal condition is no longer present.

* * * * *